US006602846B1

(12) United States Patent
Kubota et al.

(10) Patent No.: US 6,602,846 B1
(45) Date of Patent: Aug. 5, 2003

(54) METHOD FOR PRODUCING SINGLE NUCLEUS DETERGENT PARTICLES

(75) Inventors: Teruo Kubota, Wakayama (JP); Hitoshi Takaya, Wakayama (JP); Motomitsu Hasumi, Wakayama (JP); Hiroyuki Yamashita, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/762,934

(22) PCT Filed: Jun. 14, 2000

(86) PCT No.: PCT/JP00/03858

§ 371 (c)(1),
(2), (4) Date: Feb. 14, 2001

(87) PCT Pub. No.: WO00/77149

PCT Pub. Date: Dec. 21, 2000

(30) Foreign Application Priority Data

Jun. 14, 1999 (JP) ..... 11-167318
Jun. 16, 1999 (JP) ..... 11-170363

(51) Int. Cl.[7] ..... C11D 11/00

(52) U.S. Cl. ..... 510/444; 510/349; 510/441; 510/438

(58) Field of Search ..... 510/441, 444, 510/438, 349

(56) References Cited

U.S. PATENT DOCUMENTS 4,406,808 A * 9/1983 Gangwisch et al. ..... 510/323
5,139,693 A * 8/1992 Wilms et al. ..... 510/438
5,160,657 A * 11/1992 Bortolotti et al. ..... 510/444
5,736,501 A * 4/1998 Yamashita et al. ..... 510/444
6,376,453 B1 * 4/2002 Kubota et al. ..... 510/438

FOREIGN PATENT DOCUMENTS

| | | | |
|---|---|---|---|
| EP | 0651050 | A1 * | 5/1995 |
| EP | 0 816 485 | A1 | 1/1998 |
| EP | 0969082 | | 1/2000 |
| JP | 61 066799 | A | 4/1986 |
| JP | A6128598 | | 5/1994 |
| JP | 09241677 | A2 * | 9/1997 |
| JP | 09241678 | A2 * | 9/1997 |
| WO | A1-9405761 | | 3/1994 |
| WO | A1-992930 | | 6/1999 |

* cited by examiner

*Primary Examiner*—Lorna M. Douyon
(74) *Attorney, Agent, or Firm*—Birch, Stewart, Kolasch & Birch, LLP

(57) ABSTRACT

The present invention relates to a process for preparing uni-core detergent particles having a degree of particle growth of 1.5 or less and a bulk density of 500 g/L or more, comprising the steps of (A-I) mixing base particles for supporting a surfactant which have an average particle size of from 150 to 500 $\mu$m and a bulk density of 400 g/L or more [Component (a)] with a surfactant composition [Component (c)]; (A-II) mixing a mixture obtained in Step (A-I) with a powdery builder [Component (b)] of which primary average particle size is from 3 to 30 $\mu$m; and (A-III) mixing a mixture obtained in Step (A-II) with a fine powder [Component (d)] of which primary average particle size is smaller than that of Component (b). By using the process of the present invention, the uni-core detergent particles which are excellent in the dissolubility and the flowability properties can be prepared.

5 Claims, 2 Drawing Sheets

(1)

(2)

METHOD FOR PRODUCING SINGLE NUCLEUS DETERGENT PARTICLES

This application is the national phase under 35 U.S.C. §371 of PCT International Application No. PCT/JP00/03858 which has an International filing date of Jun. 14, 2000, which designated the United States of America.

TECHNICAL FIELD

The present invention relates to a process for preparing uni-core detergent particles being excellent in dissolubility and flowability properties, the uni-core detergent particles formulated with a powdery builder and supporting a surfactant composition.

BACKGROUND ART

General processes for preparing powdery detergent particle containing a powdery builder include a preparation process comprising dissolving or dispersing components which are desired to be formulated in water, and spray-drying the mixture; a preparation process comprising aggregating (granulating) a powdery builder with a liquid binder or by compression; a dry-blend process; an extrusion/disintegration process of a detergent component paste; or combinations of the above processes. However, in these preparation processes, it has been difficult to satisfy both the fast dissolubility and the flowability properties of the detergent particle.

DISCLOSURE OF INVENTION

Accordingly, an object of the present invention is to provide a process for preparing uni-core detergent particles being excellent in the dissolubility and the flowability properties in the process for preparing detergent particles comprising a powdery builder.

The above object and other objects of the present invention will be apparent from the following description.

Specifically, the present invention relates to:

[1] a process for preparing uni-core detergent particles having a degree of particle growth of 1.5 or less and a bulk density of 500 g/L or more, comprising the steps of:

(A-I): mixing base particles for supporting a surfactant which have an average particle size of from 150 to 500 μm and a bulk density of 400 g/L or more [Component (a)] with a surfactant composition [Component (c)];

(A-II): mixing a mixture obtained in Step (A-I) with a powdery builder [Component (b)] of which primary average particle size is from 3 to 30 μm in an amount of from 5 to 50 parts by weight, based on 100 parts by weight of Component (a); and (A-III): mixing a mixture obtained in Step (A-II) with a fine powder [Component (d)] of which primary average particle size is smaller than that of Component (b) in an amount of from 5 to 100 parts by weight, based on 100 parts by weight of the mixture, wherein a formulation ratio of Component (a) and Component (c) in Step (A-I) is such that an amount of Component (c) is from 20 to 100 parts by weight, based on 100 parts by weight of Component (a);

[2] a process for preparing uni-core detergent particles having a degree of particle growth of 1.5 or less and a bulk density of 500 g/L or more, comprising the steps of:

(B-I): mixing Component (a), a powdery builder [Component (b')] of which primary average particle size is from 5 to 50 μm and Component (c); and (B-II): mixing a mixture obtained in Step (B-I) with a fine powder [Component (d')] of which primary average particle size is smaller than that of Component (b') in an amount of from 5 to 100 parts by weight, based on 100 parts by weight of the mixture, wherein formulation ratios among Component (a), Component (b') and Component (c) in Step (B-I) are such that an amount of Component (b') is from 5 to 50 parts by weight and an amount of Component (c) is from 20 to 100 parts by weight, based on 100 parts by weight of Component (a), and wherein the primary average particle size of Component (d') is smaller than that of Component (b'); and

[3] a process for preparing uni-core detergent particles having a degree of particle growth of 1.5 or less and a bulk density of 500 g/L or more, comprising the steps of:

(C-I): mixing Component (a), Component (b') in an amount of from 5 to 50 parts by weight, based on 100 parts by weight of Component (a), and Component (c);

(C-II): mixing a mixture obtained in Step (C-I) with Component (b) in an amount of from 5 to 50 parts by weight, based on 100 parts by weight of Component (a); and (C-III): mixing a mixture obtained in Step (C-II) with Component (d) in an amount of from 5 to 100 parts by weight, based on 100 parts by weight of the mixture, wherein a formulation ratio of Component (a) and Component (c) in Step (C-I) is such that an amount of Component (c) is from 20 to 100 parts by weight, based on 100 parts by weight of Component (a).

BRIEF DESCRIPTION OF THE DRAWINGS

FIG. 2(2) is a perspective view of the holding member.

BEST MODE FOR CARRYING OUT THE INVENTION

Figure 1:
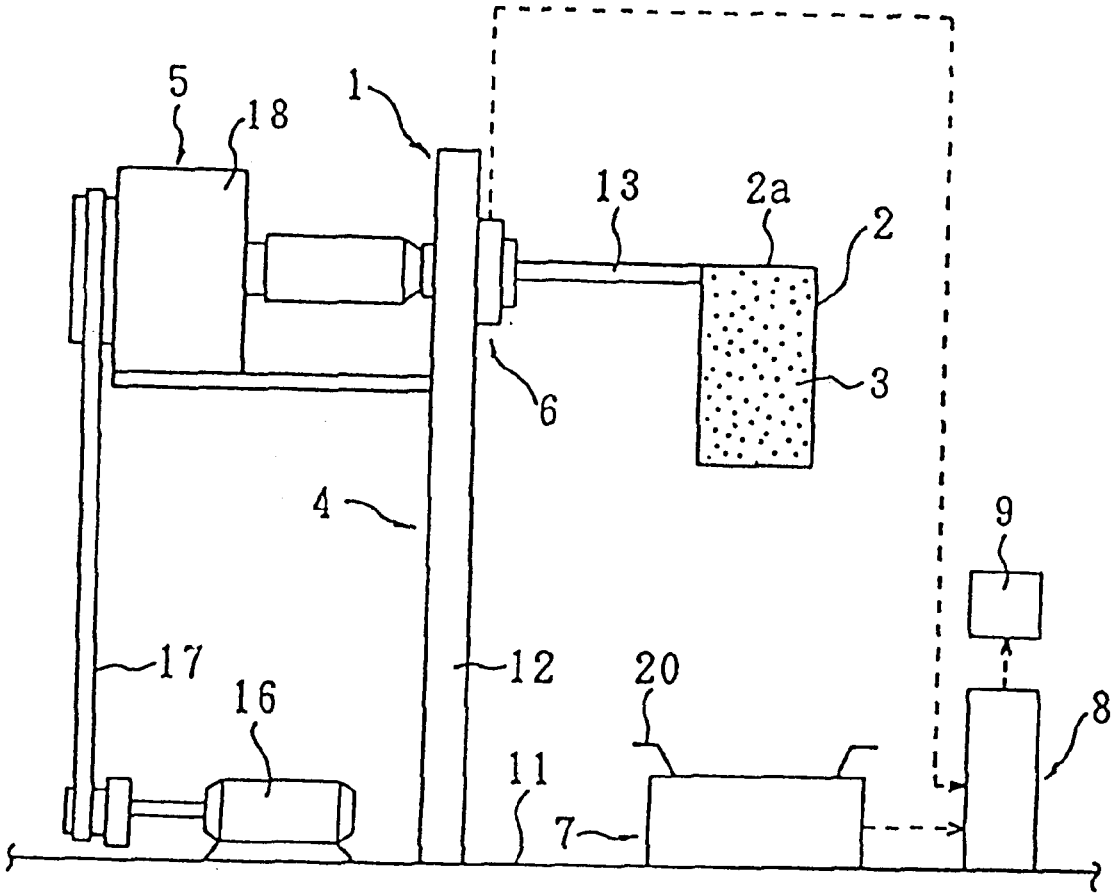
FIG. 1 is a front view showing a measurement device for flowability properties, wherein 1 is a measurement device for flowability properties, 2 is a holding member, 2*a* is a cascading portion, 3 is powder, 4 is a supporting mechanism, 5 is a tilted device, 6 is a tilted measurement device, 7 is a weight measurement device, 8 is a computer, 9 is an output device, 11 is a base, 12 is a column, 13 is a rotating member, 16 is a motor, 17 is an electric-motor winding mechanism, 18 is a decelerating mechanism, and 20 is a receiver portion of the weight measurement device 7.

The process for preparing uni-core detergent particles of the present invention can be roughly classified into the following three embodiments.

[Embodiment 1] a process for preparing uni-core detergent particles having a degree of particle growth of 1.5 or less and a bulk density of 500 g/L or more, comprising the steps of:

(A-I): mixing base particles for supporting a surfactant which have an average particle size of from 150 to 500 μm and a bulk density of 400 g/L or more [Component (a)] with a surfactant composition [Component (c)];

(A-II): mixing a mixture obtained in Step (A-I) with a powdery builder [Component (b)] of which primary average particle size is from 3 to 30 μm in an amount of from 5 to 50 parts by weight, based on 100 parts by weight of Component (a); and (A-III): mixing a mixture obtained in Step (A-II) with a fine powder [Component (d)] of which primary average particle size is smaller than that of Component (b) in an amount of from 5 to 100 parts by weight, based on 100 parts by weight of the mixture, wherein a formulation ratio of Component (a) and Component (c) in Step (A-I) is such that an amount of Component (c) is from 20 to 100 parts by weight, based on 100 parts by weight of Component (a);

[Embodiment 2] a process for preparing uni-core detergent particles having a degree of particle growth of 1.5 or less and a bulk density of 500 g/L or more, comprising the steps of:

(B-I): mixing Component (a), Component (b') and Component (c); and (B-II): mixing a mixture obtained in Step (B-I) with Component (d') in an amount of from 5 to 100 parts by weight, based on 100 parts by weight of the mixture, wherein formulation ratios among Component (a), Component (b') and Component (c) in Step (B-I) are such that an amount of Component (b') is from 5 to 50 parts by weight and an amount of Component (c) is from 20 to 100 parts by weight, based on 100 parts by weight of Component (a), and wherein the primary average particle size of Component (d') is smaller than that of Component (b');

[Embodiment 3] a process for preparing uni-core detergent particles having a degree of particle growth of 1.5 or less and a bulk density of 500 g/L or more, comprising the steps of:

(C-I): mixing Component (a), Component (b') in an amount of from 5 to 50 parts by weight, based on 100 parts by weight of Component (a), and Component (c);

(C-II): mixing a mixture obtained in Step (C-I) with Component (b) in an amount of from 5 to 50 parts by weight, based on 100 parts by weight of Component (a); and (C-III): mixing a mixture obtained in Step (C-II) with Component (d) in an amount of from 5 to 100 parts by weight, based on 100 parts by weight of the mixture, wherein the formulation ratio of Component (a) and Component (c) in Step (C-I) is such that the proportion of Component (c) is from 20 to 100 parts by weight, based on 100 parts by weight of Component (a).

Embodiment 1

<Component (a)>

Component (a) refers to base particles for supporting a surfactant having an average particle size of from 150 to 500 μm, and a bulk density of 400 g/L or more.

Component (a) has an average particle size of from 150 to 500 μm, preferably from 180 to 350 μm, from the viewpoint of obtaining detergent particles excellent in the dissolubility and the flowability properties, and a bulk density of 400 g/L or more, preferably 500 g/L or more, from the viewpoint of the compression of the detergent particles, and a bulk density of preferably 1500 g/L or less, more preferably 1200 g/L or less, from the viewpoint of the dissolubility.

It is preferable that Component (a) has a higher ability of supporting a liquid component (supporting ability). The supporting ability is preferably 20 mL/100 g or more, more preferably 40 mL/100 g or more. When the supporting ability is within this range, the aggregation of Components (a) themselves is suppressed, thereby making it favorable for maintaining the uni-core property owned by the particle in the detergent particles.

In addition, it is preferable that Component (a) is harder from the viewpoint of suppressing the disintegration of Component (a) during mixing in Steps (A-I) and (A-II). Concretely, Component (a) has a particle strength of preferably 100 kg/cm$^2$ or more, more preferably 200 kg/cm$^2$ or more.

The average particle size of Component (a) is measured by vibrating a sample with each of standard sieves according to JIS Z 8801 for 5 minutes, and thereafter determining the average particle size from a weight percentage depending upon the size openings of the sieves. The bulk density of Component (a) is measured by a method according to JIS K 3362.

The supporting ability of Component (a) is measured as follows.

A cylindrical mixing vessel of an inner diameter of 5 cm and a height of 15 cm which is equipped with agitation impellers in the inner portion thereof is charged with 100 g of a sample. With stirring the agitation impellers at 350 rpm, linseed oil at 25° C. is supplied into the vessel at a rate of 10 mL/min. The supporting ability is defined as an amount of linseed oil supplied when the agitation torque reaches the highest level.

The particle strength is measured by the following method.

A cylindrical vessel of an inner diameter of 3 cm and a height of 8 cm is charged with 20 g of a sample, and the sample-containing vessel (manufactured by Tsutsui Rikagaku Kikai K.K., "Model TVP1" tapping-type close-packed bulk density measurement device; tapping conditions: frequency of 36 times/minute, free fall from a height of 60 mm) is tapped for 30 times. The sample height immediately after the termination of the tapping operation is measured, which is defined as an initial sample height. Thereafter, an entire upper end surface of the sample kept in the vessel is pressed at a rate of 10 mm/min with a pressing machine to obtain measurements for a load-displacement curve. The slope of the linear portion at a displacement rate of 5% or less in the curve is multiplied by an initial sample height, and the resulting product is divided by a pressed area, to give a quotient which is defined as particle strength.

Component (a) can be obtained by, for example, drying a slurry comprising a detergent builder and the like. Among them, the particle obtainable by spray-drying a slurry is preferable from the viewpoint of having desired property values.

Component (a) as described above can be obtained by, for example, spray-drying a slurry comprising a water-insoluble inorganic compound, a water-soluble polymer and a water-soluble salt, in which the contents of each of the components are respectively from 20 to 90% by weight, from 2 to 30% by weight, and from 5 to 78% by weight, on a solid basis of ingredients in the slurry. Within the above compositional ranges, the average particle size, the bulk density, the supporting ability and the particle strength can be controlled by adjusting the drying process and the drying conditions. The contents of the water-insoluble inorganic compound, the water-soluble polymer and the water-soluble salt in the slurry are respectively more preferably within the ranges of from 30 to 75% by weight, from 3 to 20% by weight, and from 10 to 67% by weight, especially preferably within the ranges of from 40 to 70% by weight, from 5 to 20% by weight, and from 20 to 55% by weight, on the basis of solid ingredients in the slurry.

Here, the water-insoluble inorganic compound refers to those having a solubility to water at 25° C. of less than 0.5 g/100 g. The water-soluble polymer refers to an organic polymer having a solubility to water at 25° C. of 0.5 g/100 g or more and a molecular weight of 1000 or more. The water-soluble salt refers to those having a solubility to water at 25° C. of 0.5 g/100 g or more and a molecular weight of less than 1000.

In addition to the water-insoluble inorganic compound, the water-soluble polymer and the water-soluble salt, Component (a) may comprise auxiliary components suitable for a final detergent composition, such as a surfactant and a fluorescent dye. The amount of the auxiliary components formulated is preferably 10% by weight or less.

Here, the water-insoluble inorganic compound includes aluminosilicates, silicon dioxide, hydrated silicate compounds, clay compounds such as perlite and bentonite, and the like. The water-soluble polymer includes carboxylic acid-based polymers, carboxymethyl cellulose, water-soluble starches, sugars, and the like. The water-soluble salts include water-soluble inorganic salts representatively exemplified by alkali metal salts, ammonium salts or amine salts, each having carbonate group, hydrogencarbonate group, sulfate group, sulfite group, hydrogensulfate group, hydrochloride group, phosphate group, or the like; and water-soluble organic salts having low molecular weights such as citrates and fumarates, and the like.

Incidentally, Component (a) preferably has the following structures (1) and/or (2) from the viewpoint of the dissolubility of the uni-core detergent particles.

Structure (1): a structure having a pore capable of releasing a bubble having a size of preferably 1/10 or more, more preferably 1/5 or more, still more preferably 1/4 or more, especially preferably 1/3 or more, of a particle size of the uni-core detergent particle, when dissolving a uni-core detergent particle in water.

Structure (2): a structure comprising a water-insoluble inorganic compound, a water-soluble polymer and a water-soluble salt, and being localized so that larger portions of the water-soluble polymer and/or the water-soluble salt (hereinafter referred to as water-soluble polymer and the like) are present near the surface rather than in the inner portion thereof.

When Component (a) takes the structure (1), in a process where the detergent particle is dissolved in water, the detergent particle firstly releases a bubble having a given size from the inner portion of the particle when allowing a small amount of water to enter into the inner portion of the particle, and subsequently the particle itself undergoes disintegration (self-disintegration of the particle) by allowing a large amount of water to enter into the inner portion of the particle. Therefore, not only the dissolution from a portion near the surface takes place but also the dissolution and disintegration from the inner portion of the particle take place, whereby the detergent particle has a fast dissolubility.

This bubble-releasing phenomenon can be confirmed by a digital microscope or an optical microscope or the like, and the bubble diameter (projected area diameter) can be measured. In addition, as to the pore size of Component (a), it is preferable that pores having a size of preferably from 1/10 to 4/5, more preferably from 1/5 to 4/5 of the particle size are present. This pore size can be measured as follows. Component (a) is split at a cross section so as to include the maximum particle size without crashing the particle with a surgical knife, or the like. The split cross section is observed by a scanning electron microscope. In a case where the equivalent diameter (particle size) [$\gamma$ $\mu$m] of a split cross section of the split particle and the presence of a pore in the inner portion of the particle are confirmed, an equivalent diameter of the pore (pore size) [$\delta$ $\mu$m] is measured. Incidentally, in a case where a plurality of pores are confirmed, the equivalent diameter $\delta$ $\mu$m is defined as the largest pore size among them. Thereafter, the ratio of the pore size to the particle size ($\delta/\gamma$) is calculated.

When Component (a) takes the structure (2), there is exhibited a dissolution behavior in which the water-soluble components present near the surface are dissolved more quickly in water, so that the disintegration of the detergent particle from the particle surface is promoted, whereby the fast dissolubility can be exhibited.

Incidentally, the most preferable embodiment for exhibiting fast dissolubility is an embodiment where Component (a) takes both structures (1) and (2).

The localized structure of the water-soluble polymer or the like can be confirmed by the following method.

First, Component (a) which is to be measured and a grounded product of Component (a) in which Component (a) is sufficiently pulverized in a uniform state with an agate mortar or the like are prepared. Thereafter, under the conditions that information up to a depth of about 10 $\mu$m is obtained from the surfaces of Component (a) and the grounded product of Component (a), determinations for both are made with a combined method of Fourier transform infrared spectroscopy (FT-IR) and photoacoustic spectroscopy (PAS) (simply referred to as "FT-IR/PAS"). When the amount of the water-soluble polymer and the like of the former is larger than that of the latter, Component (a) to be measured has a structure such that larger portions of the water-soluble polymer and the like are present near the surface rather than the inner portion thereof. The measurement conditions for obtaining information up to about 10 $\mu$m from the surfaces of Component (a) and the grounded product of Component (a) include, for instance, resolution of 8 $cm^{-1}$, scanning speed of 0.63 cm/s, and 128 scans. The device used includes, for instance, an infrared spectrometer "Model FTS-60A/896" manufactured by Bio-Rad Laboratories, and the PAS cell includes a photoacoustic detector "Model 300" manufactured by MTEC Corporation. FT-IR/PAS is described in "*APPLIED SPECTROSCOPY*," 47, 1311–1316 (1993).

<Component (b)>

Component (b) may be aggregated, but is necessary to be a powdery builder of which primary particle has an average particle size of from 3 to 30 $\mu$m, and it means a detergency enhancer or an oil-absorbing agent, which is a powder at an ordinary temperature. Concretely, there are included base materials showing metal ion capturing ability, such as citrates; base materials showing alkalizing ability, such as sodium carbonate and potassium carbonate; base materials having both metal ion capturing ability and alkalizing ability, such as crystalline silicates; powdery surfactants; and the like. The uni-core detergent particles excellent in the dissolubility and the flowability properties can be prepared by using Component (b) having the average particle size as defined above. Incidentally, the definition of the uni-core detergent particles is described later.

Generally, many of the base materials showing metal ion capturing ability and/or alkalizing ability are hydrated compounds which retain water in a bound state such as crystal water in the molecule, crystal or cluster. The hydrated compounds include, for example, citrates, carbonates, bicarbonates, phosphates or crystalline silicates of alkali metals.

Preferable Component (b) is a crystalline alkali metal silicate comprising at least $SiO_2$ and $M_2O$ (M represents an alkali metal), the crystalline alkali metal silicate having an $SiO_2/M_2O$ molar ratio of from 1.5 to 2.6, a maximum value of pH of a 0.1% by weight aqueous dispersion thereof at 20° C. of exceeding 11.0, and an ion exchange capacity of 100 mg $CaCO_3$/g or more.

Here, as the crystalline alkali metal silicates, crystalline silicates disclosed in Japanese Patent Laid-Open No. Hei 5-279013, column 3, line 17 to column 6, line 24 (especially, those prepared by a process comprising calcinating and crystallizing at a temperature of 500° to 1000° C. are preferable); Japanese Patent Laid-Open No. Hei 7-89712, column 2, line 45 to column 9, line 34; and Japanese Patent Laid-Open No. Sho 60-227895, page 2, lower right column, line 18 to page 4, upper right column, line 3 (especially silicates in Table 2 are preferable) can be preferably used.

Method for Measuring Ion Exchange Capacity

First, 0.1 g of a sample is weighed, and dispersed in 100 mL of 500 ppm (when calculated as $CaCO_3$) aqueous calcium chloride solution. The resulting mixture is stirred at 25° C. for 10 minutes, and thereafter immediately filtered (with a 0.2 μm-filter). Ten milliliters of the filtrate is taken out, and 50 mL of ion-exchanged water is added thereto. One milliliter of a 20% by weight aqueous potassium hydroxide is added to the resulting mixture. Several drops of an NN indicator [a methanol solution of 2-hydroxy-1-(2'-hydroxy-4'-sulfo-1'-naphthylazo)-3-naphthoic acid], and thereafter the resulting mixture is titrated with 0.01 M-EDTA. After the titration, the cationic exchange capacity of a sample is determined by the difference from that of the blank solution.

The average primary particle size of Component (b) is preferably 5 μm or more, more preferably 8 μm or more, from the viewpoint of suppressing the aggregation of the base particles themselves. The average primary particle size is preferably 25 μm or less, more preferably 20 μm or less, from the viewpoint of the adhesiveness to the base particle. Therefore, from the viewpoints of the suppression of aggregation and the adhesiveness to the base particle, the average primary particle size is preferably from 5 to 25 μm, more preferably from 8 to 20 μm. The average particle size of Component (b) can be measured by a method utilizing light scattering by, for instance, a particle analyzer (manufactured by Horiba, LTD.), or it may be measured by a microscopic observation. In addition, in the case where Component (b) is a crystalline alkali metal silicate, the average particle size is preferably within the above ranges, from the viewpoints of the pulverizability, the storage stability, and the dissolubility.

The amount of Component (b) formulated in Step (A-II) is from 5 to 50 parts by weight, based on 100 parts by weight of Component (a). The amount formulated is preferably 10 parts by weight or more, more preferably 15 parts by weight or more, from the viewpoint of exhibiting the effect of the powdery builder. The amount formulated is preferably 40 parts by weight or less, more preferably 30 parts by weight or less, from the viewpoint of suppressing the deterioration of the flowability properties of the uni-core detergent particles.

<Component (c)>

Component (c) is a surfactant composition. Component (c), which is to be mixed with Component (a), includes compositions comprising one or more surfactants selected from the group consisting of anionic surfactants, nonionic surfactants, amphoteric surfactants and cationic surfactants, and it is preferable that these compositions are in a liquid state when mixed. A more preferable embodiment is a composition comprising (i) a nonionic surfactant, (ii) an anionic surfactant having sulfate group or sulfonate group in an amount of from 0 to 300 parts by weight, based on 100 parts by weight of the nonionic surfactant, and (iii) an immobilization agent for the nonionic surfactant in an amount of from 1 to 100 parts by weight, based on 100 parts by weight of the nonionic surfactant. The component (ii) is contained in an amount of more preferably from 20 to 200 parts by weight, especially preferably from 30 to 180 parts by weight, in the composition. In addition, the component (iii) is contained in an amount of more preferably from 5 to 50 parts by weight, especially preferably from 5 to 30 parts by weight, in the composition. It is especially preferable to use this Component (c) because the dissolubility and the flowability properties of the detergent particles can be improved, the disintegration of Component (a) during mixing can be suppressed, and the bleed-out of Component (c) can be suppressed during storage (at an ordinary temperature). The formulation of the anionic surfactant having sulfate group or sulfonate group is more advantageous for the improvement in the flowability properties of detergent particles and the suppression of the bleed-out of Component (c) during storage (at an ordinary temperature).

The immobilization agent for the nonionic surfactant in the present specification means a base material capable of suppressing the flowability of the nonionic surfactant which is liquid at an ordinary temperature and remarkably enhancing the hardness in a state in which the flowability of the surfactant composition is lost. The immobilization agent includes, for instance, salts of fatty acids, polyethylene glycols, polypropylene glycols, polyoxyethylene alkyl ethers, Pluronic-type nonionic surfactants, and the like.

In addition, Component (c) may comprise water. Especially, in the case where a salt of a fatty acid is used as the component (iii), it is preferable that the water is contained, because the compatibility with the nonionic surfactant is increased, and also because there is an effect of reducing the viscosity at a temperature of the pour point of Component (c) or higher. Also, it is preferable from the viewpoints of the handleability during the preparation and the suppression of aggregation of Components (a) themselves. The water content is preferably from 5 to 20 parts by weight, more preferably from 8 to 15 parts by weight, of Component (c).

The amount of Component (c) formulated in Step (A-I) is from 20 to 100 parts by weight, preferably from 25 to 80 parts by weight, more preferably from 30 to 70 parts by weight, based on 100 parts by weight of Component (a), from the viewpoint of exhibiting the detergency. Within the above ranges, the uni-core detergent particles excellent in the dissolubility and the flowability properties are obtained.

<Component (d)>

The fine powder which is Component (d) refers to a powder which is formulated for the purpose of coating the surface of a mixture obtained in Step (A-II), thereby further improving the flowability properties of the particles. Therefore, in Component (d) (Component (d) may be aggregated), its average primary particle size is smaller than the average primary particle size of Component (b). Two or more components may be used for Component (d), and in that case, it is preferable that the average primary particle size of the mixture is smaller than the average primary particle size of Component (b). Component (d) is preferably those having a high ion exchange ability and a high alkalizing ability from the viewpoint of the detergency. Concretely, aluminosilicates are desirable. Aside from the aluminosilicates, inorganic fine powders such as those obtained by further pulverizing Component (b), calcium silicates, silicon dioxide, bentonite, talc, clay, amorphous silica derivatives and silicate compounds are also preferable. In addition, metal soaps can be similarly used.

Concretely, the average primary particle size is preferably from 0.1 to 10 μm, more preferably from 0.1 to 8 μm, still more preferably from 0.1 to 5 μm. The average particle size of Component (d) is measured by a method utilizing light scattering, for instance, by a particle analyzer (manufactured by Horiba, LTD.), or it may be measured by a microscopic observation.

The amount of Component (d) used, based on 100 parts by weight of the mixture obtained in Step (A-II), is 5 parts by weight or more, preferably 10 parts by weight or more, from the viewpoint of the efficiency of surface-coating. In addition, the amount used is 100 parts by weight or less, preferably 75 parts by weight or less, more preferably 50 parts by weight or less, from the viewpoint of the flowability properties. Therefore, from the viewpoints of the efficiency of surface-coating and the flowability properties, the amount used is preferably from 10 to 75 parts by weight, more preferably from 10 to 50 parts by weight.

<Process for Preparing Uni-Core Detergent Particles>

1. Step (A-I)

This step comprises mixing Component (a) with Component (c) at a given formulation ratio. By this step, Component (c) is supported in Component (a). As preferable mixing conditions, the temperature of the mixture during mixing is at a pour point of Component (c) or higher, and the mixing is carried out with the agitation torque which is made as low as possible in the mixable range of each component, from the viewpoints of the suppression of disintegration of Component (a) and the promotion of supports of Component (c).

In the case where mixing is carried out by a batch process, the mixer is not particularly limited, as long as a mixer which can satisfy the above-mentioned conditions is employed. Examples thereof include (1) a mixer in which blending of powders is carried out by having an agitating shaft in the inner portion of a mixing vessel and attaching agitating impellers on the agitating shaft, including Henschel Mixer (manufactured by Mitsui Miike Machinery Co., Ltd.), High-Speed Mixer (Fukae Powtec Corp.), Vertical Granulator (manufactured by Powrex Corp.), Lödige Mixer (manufactured by Matsuzaka Giken Co., Ltd.), PLOUGH SHARE Mixer (manufactured by PACIFIC MACHINERY & ENGINEERING Co., LTD.), and the like; (2) a mixer in which blending is carried out by rotating spiral ribbon impellers in a non-rotatable vessel which is cylindrical or semi-cylindrical, including Ribbon Mixer (manufactured by Nichiwa Kikai Kogyo K.K.), Batch Kneader (manufactured by Satake Kagaku Kikai Kogyo K.K.), and the like; (3) a mixer in which blending is carried out by revolving a screw along a conical vessel, with autorotation centering about a rotating shaft arranged parallel to the vessel wall, including Nauta Mixer (manufactured by Hosokawa Micron Corp.), and the like.

In addition, in a case where mixing is carried out in a continuous process, the mixer is not particularly limited, as long as a continuous mixer which can satisfy the above-mentioned conditions is employed. For instance, Component (a) and Component (b) may be mixed by using a continuous-type mixer among the above-mentioned mixers.

Preferable mixing time (in the case of batch process) and average residence time (in the case of continuous process) are, for instance, preferably from 1 to 20 minutes, especially preferably from 2 to 10 minutes.

2. Step (A-II)

This step comprises mixing a mixture obtained in Step (A-I) with Component (b). By this step, much of Component (b) coat the surface of the mixture. Step (A-II) refers to a process from the initiation of addition of Component (b) to initiation of addition of Component (d) in Step (A-III). The timing of addition of Component (b) may be adding immediately after the termination of the addition of Component (c) in Step (A-I), or adding after addition of Component (c) and subsequent sufficient mixing, and the timing can be appropriately selected as desired. In addition, Component (b) may be added in two or more stepwise portions. In addition, in this step, a part of Component (d) which is to be added in Step (A-III) can be added simultaneously with the addition of Component (b), provided that it is preferable that the amount of Component (d) formulated is in a range so that the coating of Component (b) to the mixture is not hindered. By adding a part of Component (d) in Step (A-II), the aggregation of Component (a) by themselves can be further suppressed, without deteriorating the flowability properties of the final product.

Here, in a case where a mixer comprising agitation impellers and disintegration impellers is used, the operating conditions for the disintegration impellers (rotation speed, and the like) may be appropriately set, from the viewpoints of suppressing the disintegration of Component (a) and promoting the dispersion of Component (b).

As the mixer, those mixers exemplified in Step (A-I) may be used. It is preferable that the same mixer is used in Step (A-I) and Step (A-II) by appropriately setting the operating conditions for the mixer, from the viewpoint of simplification of the equipments.

It is preferable that the mixing time is preferably from 0.3 to 5 minutes or so.

3. Step (A-III)

This step comprises mixing a mixture obtained in Step (A-II) with Component (d). In this step, Component (d) coats the surface of the mixture, whereby the uni-core detergent particles having excellent flowability properties can be obtained.

Preferable mixing conditions and mixers are mixers comprising both agitation impellers and disintegration impellers, from the viewpoint of enhancing the dispersibility of Component (d). In addition, the additives such as an enzyme and a perfume can be simultaneously added. It is preferable to add Component (d) by using a vessel rotary mixer as in a drum mixer, from the viewpoint of simplification of the equipments.

In a case where the mixer comprising an agitator is used, it is preferable that the mixing time is 0.5 to 3 minutes or so. In the case where the vessel rotary mixer is used, it is preferable that the mixing time is from 0.5 to 10 minutes or so.

Embodiment 2

<Component (a)>

Component (a) used in this embodiment may be the same as those of Embodiment 1 described above.

<Component (b')>

Component (b') is a powdery builder having an average primary particle size of from 5 to 50 μm, and it means a detergency enhancer or an oil-absorbing agent, which is a powder at an ordinary temperature. Concretely, there are included the same kinds as those of Component (b) described above except that the average primary particle size is from 5 to 50 μm. The uni-core detergent particles excellent in the dissolubility and the flowability can be prepared by using Component (b') having an average particle size as defined above. Incidentally, the definition of the uni-core detergent particles is described later.

Generally, many of the base materials showing metal ion capturing ability and/or alkalizing ability are hydrated compounds which retain water in a bound state such as crystal water in the molecule, crystal or cluster. The hydrated compounds include, for example, citrates, carbonates, bicarbonates, phosphates or crystalline silicates of alkali metals.

Preferable Component (b') is a crystalline alkali metal silicate comprising at least $SiO_2$ and $M_2O$ (M represents an alkali metal), the crystalline alkali metal silicate having an $SiO_2/M_2O$ molar ratio of from 1.5 to 2.6, a maximum value of pH of a 0.1% by weight aqueous dispersion thereof at 20° C. of exceeding 11.0, and an ion exchange capacity of 100 mg $CaCO_3$/g or more. Incidentally, the method for measuring ion exchange capacity is the same as that of Embodiment 1 described above.

The average primary particle size of Component (b') is from 5 to 50 μm (Component (b') may be aggregated). The average primary particle size is preferably 8 μm or more, more preferably 15 μm or more, from the viewpoint of suppressing the aggregation of the base particles themselves. The average primary particle size is preferably 40 μm or less, more preferably 30 μm or less, from the viewpoint of the adhesiveness to the base particle. Therefore, from the viewpoints of the suppression of aggregation and the adhesiveness to the base particle, the average primary particle size is preferably from 8 to 40 μm, more preferably from 15 to 30 μm. The average particle size of Component (b') can be measured by a method utilizing light scattering by, for instance, a particle analyzer (manufactured by Horiba, LTD.), or it may be measured by a microscopic observation. In addition, in the case where Component (b') is a crystalline alkali metal silicate, the average particle size is preferably within the above ranges, from the viewpoints of the pulverizability, the storage stability, and the dissolubility.

The amount of Component (b') formulated in Step (B-I) is from 5 to 50 parts by weight, based on 100 parts by weight of Component (a). The amount formulated is preferably 10 parts by weight or more, more preferably 15 parts by weight or more, from the viewpoint of exhibiting the effect of the powdery builder. The amount formulated is preferably 40 parts by weight or less, more preferably 30 parts by weight or less, from the viewpoint of suppressing the aggregation of the base particles themselves.

<Component (c)>

Component (c) used in this embodiment may be the same as those of Embodiment 1 described above.

The amount of Component (c) formulated is from 20 to 100 parts by weight, preferably from 25 to 80 parts by weight, more preferably from 30 to 70 parts by weight, based on 100 parts by weight of Component (a), from the viewpoint of exhibiting the detergency. Within the above ranges, the uni-core detergent particles excellent in the dissolubility and the flowability properties are obtained.

<Component (d')>

The fine powder which is Component (d') refers to a powder which is formulated for the purpose of coating the surface of a mixture obtained in Step (B-I), thereby further improving the flowability of the particles. Therefore, in Component (d') (Component (d') may be aggregated), its average primary particle size is smaller than the average primary particle size of Component (b'). Two or more components may be used for Component (d'), and in that case, it is preferable that the average primary particle size of the mixture is smaller than the average primary particle size of Component (b'). The fine powder is preferably those having a high ion exchange ability and a high alkalizing ability from the viewpoint of the detergency. Concretely, the fine powder may be the same as those of Embodiment 1 described above.

The amount of Component (d') used, based on 100 parts by weight of the mixture obtained in Step (B-I), is 5 parts by weight or more, preferably 10 parts by weight or more, from the viewpoint of the efficiency of surface-coating. In addition, the amount used is 100 parts by weight or less, preferably 75 parts by weight or less, more preferably 50 parts by weight or less, from the viewpoint of the flowability properties. Therefore, from the viewpoints of the efficiency of surface-coating and the flowability properties, the amount used is preferably from 10 to 75 parts by weight, more preferably from 10 to 50 parts by weight.

Process for Preparing Uni-Core Detergent Particles

1. Step (B-I)

This step comprises mixing Component (a), Component (b') and Component (c) at a given formulation ratio. By this step, Component (c) is supported in Component (a) and Component (b'), and much of Component (b') adheres to the surface of Component (a). The addition method for each component is arbitrary as long as the above-mentioned action can be achieved. The preferable addition process is, for instance, a process comprising previously mixing Component (a) with Component (b'), and thereafter adding Component (c) thereto by spraying. As preferable mixing conditions, the temperature of the mixture during mixing is at a pour point of Component (c) or higher, and the mixing is carried out with the agitation torque which is made as low as possible in the mixable range of each component, from the viewpoints of the suppression of disintegration of Component (a) and the promotion of supports of Component (c).

In the case where mixing is carried out by a batch process, the mixer is not particularly limited, and the same ones as those in Embodiment described above are used, as long as the mixers which can satisfy the above conditions are used.

In addition, in a case where mixing is carried out in a continuous process, the mixer is not particularly limited, as long as a continuous mixer which can satisfy the above-mentioned conditions is employed. For instance, Component (a), Component (b') and Component (c) may be mixed by using a continuous-type mixer among the above-mentioned mixers.

Preferable mixing time (in the case of batch process) and average residence time (in the case of continuous process) are, for instance, preferably from 1 to 20 minutes, especially preferably from 2 to 10 minutes.

2. Step (B-II)

This step comprises mixing a mixture obtained in Step (B-I) with Component (d') at a given formulation ratio. In this step, the fine powder coats the surface of the mixture, whereby the uni-core detergent particles having excellent flowability can be obtained.

Preferable mixing conditions are to use mixers comprising both agitation impellers and disintegration impellers, from the viewpoint of enhancing the dispersibility of Component (d'), and the operating conditions for agitation impellers and the disintegration impellers (rotation speed, and the like) may be appropriately set, so that Component (a) is not disintegrated as much as possible, from the viewpoint of enhancing the dispersibility of Component (a).

Preferable mixers include those mixers comprising both agitation impellers and disintegration impellers among the mixers usable in Step (B-I). In the case where the mixers as described above are used, it is preferable that the same mixer is used in Step (B-I) and Step (B-II), from the viewpoint of simplification of the equipments. The mixers as described above include Lödige Mixer, PLOUGH SHARE Mixer, and the like.

It is preferable that the mixing time is preferably from 0.5 to 3 minutes or so.

Embodiment 3

This embodiment refers to a technique in which a powdery builder can be formulated in a large amount without impairing the dissolubility and the flowability properties of the uni-core detergent particles in Embodiment 1 and Embodiment 2. In addition, this embodiment refers to a technique in which the dissolubility and the flowability properties are further improved when the amount of the powdery builder formulated is the same as in Embodiment 1 and Embodiment 2.

<Component (a)>

Component (a) used in this embodiment may be the same as those of Embodiment 1 described above.

<Component (b), Component (b')>

Each of Component (b) and Component (b') used in this embodiment may be the same as those of Embodiment 1 and Embodiment 2 described above.

Each of the amount of Component (b') formulated in Step (C-I) and the amount of Component (b) formulated in Step (C-II) is from 5 to 50 parts by weight, based on 100 parts by weight of Component (a). The amount formulated is preferably 10 parts by weight or more, more preferably 15 parts by weight or more, from the viewpoint of exhibiting the effect of the powdery builder. In addition, the amount formulated is preferably 40 parts by weight or less, more preferably 30 parts by weight or less, from the viewpoints of suppressing the aggregation of the base particles themselves and suppressing the deterioration of the flowability properties of the uni-core detergent particles.

The total amount of Component (b') and Component (b) formulated is preferably from 10 to 60 parts by weight, more preferably 15 parts by weight or more and 40 parts by weight or less, based on 100 parts by weight of Component (a). In addition, as to the amount of Component (b') formulated to the amount of Component (b) formulated, in the case where the water content in Component (c) is less than 5%, the amount of Component (b') formulated is preferably from 50 to 500 parts by weight, more preferably from 70 to 300 parts by weight, based on 100 parts by weight of Component (b). In the case where the water content in Component (c) is 5% by weight or more, the amount of Component (b') formulated is preferably from 25 to 250 parts by weight, more preferably from 35 to 200 parts by weight, based on 100 parts by weight of Component (b).

<Component (c)>

Component (c) used in this embodiment may be the same as those of Embodiment 1 described above.

The amount of Component (c) formulated in Step (C-I) is from 20 to 100 parts by weight, preferably from 25 to 80 parts by weight, more preferably from 30 to 70 parts by weight, based on 100 parts by weight of Component (a). Within the above ranges, the uni-core detergent particles excellent in the dissolubility and the flowability properties are obtained.

Especially, in the case where water is contained in Component (c) in an amount of 5% by weight or more and a hydrated builder is used as Component (b'), it is necessary to pay sufficient attention to the amount of Component (b') formulated in Step (C-I) and the water content of Component (c) for the reasons described below.

Specifically, in the surfactant composition, the viscosity changes depending on the water content, so that a phenomenon of remarkable thickening is exhibited when the water content is considerably decreased. Therefore, when Component (c) comprising water and hydrated Component (b') are mixed in Step (C-I), water in Component (c) is taken away by the hydration reaction of Component (b'), so that Component (c) is locally or entirely thickened.

Thickened Component (c) then acts as a binder, and accelerates the aggregation of Component (a) and/or Component (b'). As a result, the dissolubility of the detergent particles is lowered in some cases.

On the other hand, in the case where a hydrated builder is added as Component (b) in Step (C-II), since much of Component (c) has been already supported in Component (a) in Step (C-I), the effect of accelerating the aggregation of Component (a) and/or Component (b) due to the thickening of Component (c) is very small.

Therefore, in the case where a hydrated builder and an anhydrated builder are used together as a powdery builder, it is also effective to selectively use the anhydrated builder as Component (b') in Step (C-I) and the hydrated builder as Component (b) in Step (C-II), from the viewpoint of the suppression of the particle growth.

<Component (d)>

The fine powder which is Component (d) refers to a powder which is formulated for the purpose of coating the surface of a mixture obtained in Step (C-II), thereby further improving the flowability properties of the particles, and has a size smaller than the average primary particle size of Component (b). Component (d) may be the same as those of Embodiment 1 described above.

The amount of Component (d) formulated in Step (C-III), based on 100 parts by weight of the mixture obtained in Step (C-II), is 5 parts by weight or more, more preferably 10 parts by weight or more, from the viewpoint of the efficiency of surface-coating. In addition, the amount formulated is 100 parts by weight or less, preferably 75 parts by weight or less, more preferably 50 parts by weight, from the viewpoint of the flowability properties. Therefore, from the viewpoints of the efficiency of surface-coating and the flowability properties, the amount formulated is preferably from 10 to 75 parts by weight, more preferably from 10 to 50 parts by weight.

Process for Preparing Uni-Core Detergent Particles

1. Step (C-I)

This step comprises mixing Component (a), Component (b') and Component (c) at a given formulation ratio. By this step, Component (c) is supported in Component (a) and Component (b'), and much of Component (b) adheres to the surface of Component (a). The addition method for each component is arbitrary as long as the above-mentioned action can be achieved. The preferable addition process is, for instance, a process comprising previously mixing Component (a) with Component (b'), and thereafter adding Component (c) thereto by spraying. As preferable mixing conditions, the temperature of the mixture during mixing is at a pour point of Component (c) or higher, and the agitation torque is made as low as possible in the mixable range of each component, from the viewpoints of the suppression of disintegration of Component (a) and the promotion of supports of Component (c).

In the case where mixing is carried out by a batch process, the mixer is not particularly limited, and the same ones as those in Embodiment described above are used, as long as the mixers which can satisfy the above conditions are used.

In addition, in a case where mixing is carried out in a continuous process, the mixer is not particularly limited, as long as a continuous mixer which can satisfy the above-mentioned conditions is employed. For instance, Component (a), Component (b') and Component (c) may be mixed by using a continuous-type mixer among the above-mentioned mixers.

Preferable mixing time (in the case of batch process) and average residence time (in the case of continuous process)

are, for instance, preferably from 1 to 20 minutes, especially preferably from 2 to 10 minutes.

3. Step (C-II)

This step comprises mixing a mixture obtained in Step (C-I) with Component (b). By this step, much of Component (b) coat the surface of the mixture. Step (C-II) refers to a process from the initiation of addition of Component (b) to initiation of addition of Component (d) in Step (C-III). The timing of addition of Component (b) may be adding immediately after the termination of the addition of Component (c) in Step (C-I), or adding after addition of Component (c) and subsequent sufficient mixing, and the timing can be appropriately selected as desired. In addition, Component (b) may be added in two or more stepwise portions. In addition, in this step, a part of Component (d) which is to be added in Step (C-III) can be added simultaneously with the addition of Component (b), provided that it is preferable that the amount of Component (d) formulated is in a range so that the coating of Component (b) to the mixture is not hindered. By adding a part of Component (d) in Step (C-II), the aggregation of Component (a) by themselves can be further suppressed, without deteriorating the flowability properties of the final product.

Here, in a case where a mixer comprising agitation impellers and disintegration impellers is used, the operating conditions for the disintegration impellers (rotation speed, and the like) may be appropriately set, from the viewpoints of suppressing the disintegration of Component (a) and promoting the dispersion of Component (b).

As the mixer, those mixers exemplified in Step (A-I) may be used. It is preferable that the same mixer is used in Step (C-I) and Step (C-II) by appropriately setting the operating conditions for the mixer, from the viewpoint of simplification of the equipments.

It is preferable that the mixing time is preferably from 0.3 to 5 minutes or so.

3. Step (C-III)

This step comprises mixing a mixture obtained in Step (C-II) with Component (d). In this step, Component (d) coats the surface of the mixture, whereby the uni-core detergent particles having excellent flowability properties can be obtained.

Preferable mixing conditions and mixers are mixers comprising both agitation impellers and disintegration impellers, from the viewpoint of enhancing the dispersibility of Component (d). In addition, the additives such as an enzyme and a perfume can be simultaneously added. It is preferable to add Component (d) by using a vessel rotary mixer as in a drum mixer, from the viewpoint of simplification of the equipments.

In a case where the mixer comprising an agitator is used, it is preferable that the mixing time is from 0.5 to 3 minutes or so. In the case where the vessel rotary mixer is used, it is preferable that the mixing time is from 0.5 to 10 minutes or so.

<Uni-Core Detergent Particles>

The uni-core detergent particles prepared by the process of Embodiment 1, Embodiment 2 or Embodiment 3 described above refer to detergent particles prepared by using Component (a) as a core, the detergent particles substantially comprise one base particle as a core in one detergent particle.

As an index for expressing uni-core property of the detergent particles, the degree of particle growth defined by the following equation can be used. The uni-core detergent particles as referred to in the present invention have a degree of particle growth of 1.5 or less, preferably 1.3 or less, more preferably 1.2 or less.

$$\text{Degree of Particle Growth} = \frac{\text{Average Particle Size of Final Detergent Particles}}{\text{Average Particle Size of Component (a)}}$$

The term "final detergent particles" refers to detergent particles obtained after Step (A-III), Step (B-II) or Step (C-III).

In the above uni-core detergent particle, since the intra-particle aggregation is suppressed, the formation of particles (aggregated particle) having sizes outside the desired particle size range is suppressed, i.e. indicating that there are little variations in the average particle size and the particle size distribution of the detergent particles obtained with respect to the variation of the amount of the surfactant formulated, whereby the detergent particles having excellent dissolubility are obtained in a high yield.

<Preferable Properties of Uni-Core Detergent Particles and Methods for Measuring the Properties>

The uni-core detergent particles have a bulk density of 500 g/L or more, preferably from 500 to 1000 g/L, more preferably from 600 to 1000 g/L, especially preferably from 650 to 850 g/L. The uni-core detergent particles have an average particle size of preferably from 150 to 500 $\mu$m, more preferably from 180 to 350 $\mu$m. The methods for measuring the bulk density and the average particle size are the same as those for Component (a).

The uni-core detergent particles obtained by the process of the present invention are those excellent in the flowability properties. The phrase "excellent in the flowability properties" is concretely defined as described below.

The uni-core detergent particles have a variance of powder dropping rate (V) of preferably 2.0 or less, more preferably 1.5 or less, still more preferably 1.0 or less, especially preferably 0.8 or less, still more preferably 0.6 or less.

The variance of the powder dropping rate V is measured in the following manner.

Figure 2:
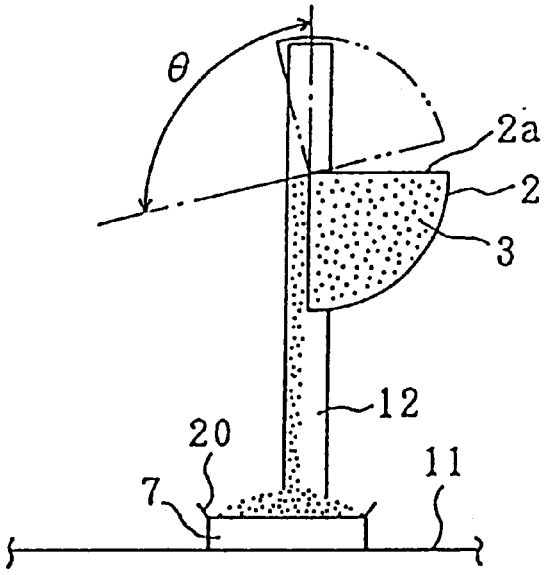
FIG. 2(1) is a partial side view of the measurement device for flowability properties.
Figure 2:
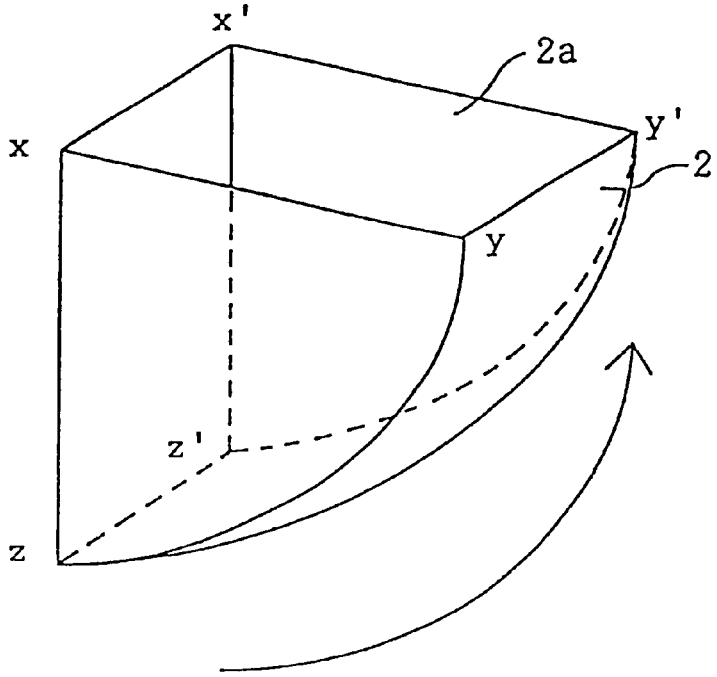

The measurement is carried out by using a "measuring device for powder flowability properties" as shown in FIG. 1. The measurement device 1 for powder flowability properties is provided for measuring the flowability properties of a powder 3 retained by a holding member 2, wherein the holding member 2 comprises a supporting mechanism 4, a tilted device 5, a tilted measurement device 6, a weight measurement device 7, and a computer 8. The supporting mechanism 4 comprises a base 11, a column 12 arranged thereon, and a rotating member 13 rotatably supported by the column, centering about a horizontal shaft, and the holding member 2 is detachably arranged to a tip end of the rotating member 13. As shown in FIG. 2(1) and (2), the holding member 2 is a vessel having an upper aperture which is characterized in that its side surface has a shape of a sector, wherein the aperture is a cascading portion 2*a* of the powder 3. In addition, a computer 8 is connected to an output device 9.

The tilted device 5 transmits the rotations of a motor 16 arranged on the base 11 to the above rotating member 13 through an electric-motor winding mechanism 17 and a decelerating mechanism 18. By rotating this rotating member 13, the holding member 2 supported by the above supporting mechanism 4 is gradually tilted at a set velocity. By the tilting, the powder 3 retained in the holding member 2 can be dropped from the cascading portion 2*a*. The motor 16 is connected to a rate-regulating device not illustrated in the figure, and the tilting velocity of the holding member 2 can be regulated by varying the rotational speed.

Concrete operations are as follows. A cascading portion 2*a* is provided in the holding member 2 such that the cascading portion has a height of 20 cm from a receiver 20 of the weight measurement device 7, and then an angle θ of the holding member 2 is set at 0°. Next, a measurement sample is poured to a cascading portion 2*a* in a sufficient amount using a funnel from a height of 10 cm above the cascading portion 2*a*, and thereafter a sample filled over the brim of the cascading portion 2*a* is removed by gentle leveling. The holding member 2 is rotated at an angular velocity of 6.0° per one second, until the angle θ of the holding member 2 is changed from 0° to 180° (FIGS. 2(1), (2)). During this period, the measurement of the dropped weight of the sample is taken every 1/80 seconds with a weight measurement device, and the θ and the dropped weight at an instant time are sequentially recorded.

Thereafter, the differentiation value of the dropping ratio at a slanted angle θ of the holding member 2 is defined as a dropping rate at an angle θ (%/deg.), and denoted as v(θ). However, in order to reduce noise, the dropping ratio and the dropping rate at a slant θ of the holding member are defined by carrying out the following data processing.

The dropping ratio (%) at an angle θ is defined by a ratio of a dropped weight at an angle θ to an entire weight of the measurement sample, wherein the dropped weight at an angle θ is an average value of measurement values of the dropped weights of a total of 40 points from an angle of (θ−2.925)° to an angle θ.

The dropping rate at an angle θ is defined as a value (%/deg.) of a slope of a straight line obtained by plotting an angle as abscissa and the dropping ratio (%) described above as coordinate for a total of 19 points from angles (θ−0.675)° to (θ+0.675)°, and obtaining the slope of a straight line by using least square method. In addition, the value of the slope of the straight line obtained by least square approximation can be obtained in accordance with JIS Z 8901.

Here, the dropping rate v(θ) (%/deg.) of the sample powder to the slanted angle θ (°) of the holding member 2 is measured, and the variance of the v(θ) value against the θ, in which the dropping ratio Y(θ) of the sample powder falls between 1% and 99%, is calculated by the following equation. This variance is defined as the variance of the powder dropping rate V.

In other words, the variance can be expressed by:

$$V=(n\Sigma(v(\theta))^2-(\Sigma v(\theta))^2)/n^2$$

wherein n is a total number of data in which Y(θ) falls between 1% and 99%.

The uni-core detergent particles have a flow time of preferably 7 seconds or shorter, more preferably 6.5 seconds or shorter. The flow time refers to a time period required for cascading 100 mL of powder from a hopper used in a measurement of bulk density as defined in JIS K 3362.

The detergent particles have an anti-caking property as evaluated by sieve permeability of preferably 90% or more, more preferably 95% or more. The testing method for caking property is as follows.

An open-top box having dimensions of 10.2 cm in length, 6.2 cm in width, and 4 cm in height is made out of a filter paper (No. 2, manufactured by ADVANTEC) by stapling the filter paper at four corners. An acrylic resin plate (15 g) and a lead plate (250 g) are placed on the box charged with a 50 g sample. The caking state after allowing the box to stand in an atmosphere of a temperature of 35° C. and a humidity of 40% for 2 weeks is evaluated by calculating the permeability as follows.

<Permeability>

A sample obtained after the above test is gently placed on a sieve (sieve opening: 4760 μm, as defined by JIS Z 8801), and the weight of the powder passing through the sieve is measured. The permeability (%) based on the sample obtained after the above test is calculated.

As to the bleed-out property of the detergent particles, it is preferable when the evaluation by the following test methods is preferably 2 rank or better, more preferably 1 rank, because contrivances are not necessary for prevention of deposition of the nonionic surfactant-containing powder to equipments during transportation, or for prevention for bleed-out to vessels.

The testing method for bleed-out property: Bleed-out state of a surfactant is visually examined at bottom (side not contacting with powder) of the vessel made of the filter paper after the anti-caking test. The examination is made based on the area of wetted portion occupying the bottom in the following 1 to 5 ranks.

Rank 1: not wetted; Rank 2: about ¼ of the bottom area being wetted; Rank 3: about ½ the bottom area being wetted; Rank 4: about ¾ of the bottom area being wetted; Rank 5: the entire bottom area being wetted.

The dissolution rate of the detergent particles is preferably 90% or more, more preferably 95% or more. The method for measuring the dissolution rate is as follows.

A 1-L beaker (a cylindrical form having an inner diameter of 105 mm and a height of 150 mm, for instance, a 1-L glass beaker manufactured by Iwaki Glass Co., Ltd.) is charged with 1 L of hard water cooled to 5° C. and having a water hardness corresponding to 71.2 mg $CaCO_3$/L (a molar ratio of Ca/Mg: 7/3). With keeping the water temperature constant at 5° C. with a water bath, water is stirred with a stirring bar (length: 35 mm and diameter: 8 mm, for instance, Model "TEFLON MARUGATA-HOSOGATA", manufactured by ADVANTEC) at a rotational speed (800 rpm), such that a depth of swirling to the water depth is about 1/3. The uni-core detergent particles which are sample-reduced and weighed so as to be 1.0000±0.0010 g are supplied and dispersed in water with stirring, and stirring is continued. After 60 seconds from supplying the particles, a liquid dispersion of the uni-core detergent particles in the beaker is filtered with a standard sieve (diameter: 100 mm) having a sieve-opening of 74 μm as defined by JIS Z 8801 (corresponding to ASTM No. 200) of a known weight. Water-containing uni-core detergent particles remaining on the sieve are collected in an open vessel of a known weight together with the sieve. Incidentally, the operation time from the start of filtration to collection of the sieve is set at 10±2 sec. The insoluble remnants of the collected uni-core detergent particles are dried for one hour in an electric desiccator heated to 105° C. Thereafter, the dried insoluble remnants are kept in a desiccator containing a silica gel (25° C.) for 30 minutes, and then cooled. After cooling the insoluble remnants, a total weight of the dried insoluble remnants of the detergent, the sieve and the collected vessel is measured, and the dissolution rate (%) of the uni-core detergent particles is calculated by the following equation:

$$\text{Dissolution Rate } (\%)=\{1-(T/S)\}\times 100$$

wherein S is a weight (g) of the uni-core detergent particles supplied; and T is a dry weight (g) of insoluble remnants of the detergent particles remaining on the sieve when an aqueous solution obtained under the above stirring conditions is filtered with the sieve [Drying Conditions: The particles are kept at a temperature of 105° C. for one hour, and thereafter kept in a desiccator containing a silica gel (25° C.) for 30 minutes.].

Here, the weight is determined by using a precision balance.

EXAMPLES

Base particles were prepared as follows.

Four-hundred and eighty kilograms of water was added to a 1 $m^3$-mixing vessel having agitation impellers. After the water temperature reached 50° C., 120 kg of sodium sulfate and 150 kg of sodium carbonate were added thereto. After stirring the resulting mixture for 15 minutes, 120 kg of a 40% by weight-aqueous sodium polyacrylate solution was added thereto. After stirring the resulting mixture for additional 15 minutes, 252 kg of zeolite was added thereto, and the resulting mixture was stirred for 30 minutes to give a uniform slurry. The final temperature of this slurry was 53° C. This slurry was subjected to spray-drying, and the resulting spray-dried particle was used as base particles. The base particles had an average particle size of 260 μm, a bulk density of. 590 g/L, a supporting ability of 52 mL/100 g, a particle strength of 280 kg/$cm^2$, and a composition (weight ratio) of zeolite/sodium polyacrylate/sodium carbonate/sodium sulfate/water of 42/8/25/20/5.

Example I-1

Detergent particles were obtained according to the following process.

<Step (A-I)>

One-hundred parts by weight (20 kg) of base particles at 80° C. as listed in Table 1 were supplied into Lödige Mixer (manufactured by Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-four parts by weight (8.8 kg) of a surfactant composition at 80° C. was supplied into the above mixer in 2 minutes, and the components were then mixed for 5 minutes.

<Step (A-II)>

Thereafter, 20 parts by weight (4 kg) of a powdery builder was supplied into this Lödige Mixer. The main shaft (rotational speed: 120 rpm) and the chopper (rotational speed: 3600 rpm) were rotated for 0.5 minutes.

<Step (A-III)>

Subsequently, 15 parts by weight (3 kg) of fine powder was supplied into this Lödige Mixer. The main shaft (rotational speed: 120 rpm) and the chopper (rotational speed: 3600 rpm) were rotated for 1 minute, and thereafter 33 kg of detergent particles were discharged. The properties of the resulting detergent particles are shown in Table 1.

TABLE 1

| | Examples | | | | | Comparative Examples | |
|---|---|---|---|---|---|---|---|
| | I-1 | I-2 | I-3 | I-4 | I-5 | I-1 | I-2 |
| Composition (Parts by Weight) | | | | | | | |
| Surfactant Composition [Component (c)] | | | | | | | |
| Nonionic Surfactant*1) | 40 | 20 | 20 | 20 | 20 | 20 | 20 |
| Immobilization Agent 1*2) | 2 | 2 | 2 | 2 | 2 | 2 | 2 |
| Immobilization Agent 2*3) | 2 | 2 | 2 | 2 | 2 | 2 | 2 |
| Anionic Surfactant*4) | — | 20 | 20 | 20 | 20 | 20 | 20 |
| Water | — | 4 | 4 | 4 | 4 | 4 | 4 |
| Base Particles [Component (a)] | | | | | | | |
| Spray-Dried Particle | 100 | 100 | 100 | 100 | 100 | 100 | 100 |
| Powdery Builder [Component (b)] | | | | | | | |
| Crystalline Alkali Metal Silicate*5) | 20 | 20 | 20 | 20 | — | — | 20 |
| Crystalline Alkali Metal Silicate*6) | — | — | — | — | — | 20 | — |
| Crystalline Alkali Metal Silicate*7) | — | — | — | — | 20 | — | — |
| Fine Powder [Component (d)] | | | | | | | |
| Crystalline Aluminosilicate*8) | 15 | 15 | 15 | 10 | 15 | 15 | 15 |
| Amorphous Aluminosilicate*9) | — | — | — | 3 | — | — | — |
| Properties | | | | | | | |
| Average Primary Particle Size (μm) | 281 | 307 | 294 | 291 | 281 | 299 | 286 |
| Degree of Particle Growth | 1.08 | 1.18 | 1.13 | 1.12 | 1.08 | 1.15 | 1.10 |
| Bulk Density (g/L) | 730 | 780 | 770 | 800 | 770 | 710 | 720 |
| Flowability Properties | | | | | | | |
| Variance of Powder Dropping Rate | 1.7 | 1.0 | 1.2 | 0.9 | 0.9 | 3.9 | 2.7 |
| Flowability (s) | 6.4 | 6.1 | 6.2 | 6.0 | 5.9 | 7.4 | 7.1 |
| Bleed-Out Property (2-Week Storage) | 2–3 | 2 | 2 | 2 | 2 | 2–3 | 2–3 |
| Anti-Caking Property (2-Week Storage) | 2–3 | 2 | 2 | 2 | 1 | 3 | 3 |
| Dissolution Rate (%) | 96 | 94 | 95 | 95 | 96 | 95 | 96 |

The details of each of the components in the table are as follows.

*1): Polyoxyethylene alkyl ether (manufactured by Kao Corporation under the trade name: EMULGEN 108 KM, average moles of ethylene oxides: 8.5, number of carbon atoms in alkyl moiety: 12 to 14; and melting point: 18° C.); *2): polyethylene glycol (manufactured by Kao Corporation under the trade name: K-PEG6000, weight-average molecular weight: 8500; melting point: 60° C.); *3): sodium palmitate; *4): sodium dodecylbenzenesulfonate; *5): Na-SKS-6 ($\delta$-$Na_2Si_2O_5$) manufactured by Clariant, average particle size: 9 $\mu$m; *6): Na-SKS-6, average particle size: 42 $\mu$m, Component (b'); *7): Na-SKS-6, average particle size: 23 $\mu$m; *8): zeolite 4A-type, average particle size: 3.5 $\mu$m; and *9): Preparation Example 2 described in Japanese Patent Laid-Open No. Hei 9-132794, average particle size: 8 $\mu$m (primary particle size: 0.1 $\mu$m).

Example I-2

Detergent particles were obtained in the same manner as in Example I-1 with each of the compositions listed in Table 1. The properties of the resulting detergent particles are shown in Table 1. The detergent particles of Example I-2 were more excellent in the flowability properties, the anti-caking property and the bleed-out property than the detergent particles of Example I-1.

Example I-3

Detergent particles were obtained in the same manner as in Example I-1 with each of the compositions listed in Table 1, except that all of the crystalline alkali metal silicate and a part (10 parts by weight out of 15 parts by weight) of the crystalline aluminosilicate were added in Step (A-II). The properties of the resulting detergent particles are shown in Table 1. The detergent particles of Example I-3 were more excellent in the dissolubility than the detergent particles of Example I-2.

Example I-4

Detergent particles were obtained in the same manner as in Example I-1 with each of the compositions listed in Table 1, except that the crystalline aluminosilicate were formulated in Step (A-II), and that an amorphous aluminosilicate was added and mixed for 2 minutes by using a cylindrical drum mixer having a diameter of 400 mm in Step (A-III). The properties of the resulting detergent particles are shown in Table 1. The detergent particles of Example I-4 were more excellent in the flowability properties than the detergent particles of Examples I-2 and I-3.

Example I-5

Detergent particles were obtained according to the following process.

<Step (A-I)>

One-hundred parts by weight (20 kg) of base particles at 80° C. as listed in Table 1 were supplied into Lödige Mixer (manufactured by Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-four parts by weight (8.8 kg) of a surfactant composition at 80° C. was supplied into the above mixer in 2 minutes, and the components were then mixed for 1 minute.

<Step (A-II)>

Thereafter, 20 parts by weight (4 kg) of a powdery builder was supplied into this Lödige Mixer, and thereafter the resulting mixture was stirred for 4 minutes.

<Step (A-III)>

Subsequently, 15 parts by weight (3 kg) of fine powder was supplied into this Lödige Mixer. The main shaft (rotational speed: 120 rpm) and the chopper (rotational speed: 3600 rpm) were rotated for 1 minute, and thereafter 35 kg of detergent particles were discharged. The properties of the resulting detergent particles are shown in Table 1. The detergent particles of Example I-5 were more excellent in the dissolubility than the detergent particles of Example II-2.

Comparative Example I-1

Detergent particles were obtained in the same manner as in Example I-1 except for the average particle size of the powdery builder. The properties of the resulting detergent particles are shown in Table 1. The detergent particles of Comparative Example I-1 were poor in their flowability properties.

Comparative Example I-2

Detergent particles were obtained in the same manner as in Example I-1, except for the process of adding the powdery builder, in which Step (A-II) was omitted, and the powdery builder was added in Step (A-III). The properties of the resulting detergent particles are shown in Table 1. The resulting detergent particle were poor in their flowability properties.

Example II-1

Detergent particles were obtained according to the following process.

<Step (B-I)>

One-hundred parts by weight (20 kg) of base particles at 80° C. as listed in Table 2 and 20 parts by weight (4 kg) of a powdery builder at room temperature were supplied into Lödige Mixer (manufactured by Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-four parts by weight (8.8 kg) of a surfactant composition at 80° C. was supplied into the above mixer in 2 minutes, and the components were then mixed for 5 minutes.

<Step (B-II)>

Subsequently, 15 parts by weight (3 kg) of fine powder was supplied into this Lödige Mixer. The main shaft (rotational speed: 120 rpm) and the chopper (rotational speed: 3600 rpm) were rotated for 1 minute, and thereafter 35 kg of detergent particles were discharged. The properties of the resulting detergent particles are shown in Table 2.

TABLE 2

| | Examples | | | Comparative Examples | | |
|---|---|---|---|---|---|---|
| | II-1 | II-2 | II-3 | II-1 | II-2 | II-3 |
| Composition (Parts by Weight) | | | | | | |
| Surfactant Composition [Component (c)] | | | | | | |
| Nonionic Surfactant*1) | 40 | 20 | 20 | 20 | 20 | 20 |
| Immobilization Agent 1*2) | 2 | 2 | 2 | 2 | 2 | 2 |
| Immobilization Agent 2*3) | 2 | 2 | 2 | 2 | 2 | 2 |
| Anionic Surfactant*4) | — | 20 | 20 | 20 | 20 | 20 |
| Water | — | 4 | 4 | 4 | 4 | 4 |
| Base Particles [Component (a)] | | | | | | |
| Spray-Dried Particle | 100 | 100 | 100 | 100 | 100 | 100 |
| Powdery Builder [Component (b')] | | | | | | |
| Crystalline Alkali Metal Silicate*6) | 20 | 20 | 20 | — | — | 20 |
| Crystalline Alkali Metal Silicate*7) | — | — | — | 20 | — | — |
| Crystalline Alkali Metal Silicate*8) | — | — | — | — | 20 | — |
| Fine Powder [Component (d')] | | | | | | |
| Crystalline Aluminosilicate*9) | 15 | 15 | 8 | 15 | 15 | — |
| Crystalline Alkali Metal Silicate*10) | — | — | 7 | — | — | — |
| Properties | | | | | | |
| Average Primary Particle Size ($\mu$m) | 268 | 294 | 291 | 434 | 286 | 273 |
| Degree of Particle Growth | 1.03 | 1.13 | 1.12 | 1.67 | 1.10 | 1.05 |
| Bulk Density (g/L) | 750 | 780 | 800 | 820 | 720 | 710 |
| Flowability Properties | | | | | | |
| Variance of Powder Dropping Rate | 1.5 | 0.9 | 1.1 | 0.8 | 2.9 | 3.8 |
| Flowability (s) | 6.3 | 5.9 | 6.0 | 5.9 | 7.1 | 7.3 |
| Bleed-Out Property (2-Week Storage) | 2–3 | 2 | 2 | 2 | 3 | 3 |
| Anti-Caking Property (2-Week Storage) | 1–2 | 1 | 1 | 1 | 2–3 | 2–3 |
| Dissolution Rate (%) | 97 | 95 | 95 | 85 | 96 | 96 |

The details of each of the components in the table are as follows.

*1): Polyoxyethylene alkyl ether (manufactured by Kao Corporation under the trade name: EMULGEN 108 KM, average moles of ethylene oxides: 8.5, number of carbon atoms in alkyl moiety: 12 to 14; and melting point: 18° C.); *2): polyethylene glycol (manufactured by Kao Corporation under the trade name: K-PEG6000, weight-average molecular weight: 8500; melting point: 60° C.); *3): sodium palmitate; *4): sodium dodecylbenzenesulfonate; *6): Na-SKS-6 ($\delta$-$Na_2Si_2O_5$, average particle size: 23 $\mu$m) manufactured by Clariant; *7): Na-SKS-6 (average particle size: 4.3 $\mu$m); *8): Na-SKS-6 (average particle size: 65 $\mu$m); *9): zeolite 4A-type (average particle size: 3.5 $\mu$m); and * 10): Na-SKS-6 (average particle size: 9 $\mu$m).

Example II-2

Detergent particles were obtained in the same manner as in Example II-1 with each of the compositions listed in Table 2. The properties of the resulting detergent particles are shown in Table 2. The detergent particles of Examples II-2 were more excellent in the flowability properties, the anti-caking property and the bleed-out property than the detergent particles of Example II-1.

Example II-3

Detergent particles were obtained in the same manner as in Example II-1 with each of the compositions listed in Table 2. The properties of the resulting detergent particles are shown in Table 2. The detergent particles of Example II-3 were more excellent in the deterging ability than the detergent particles of Example II-1.

Comparative Examples II-1 and II-2

Detergent particles were obtained in the same manner as in Example II-1 except for the average particle size of the powdery builder. The properties of the resulting detergent particles are shown in Table 2. From the finding that the detergent particles of Comparative Example II-1 had a large degree of particle growth, the resulting detergent particles were not uni-core detergent particles. In addition, the dissolubility thereof was poor. The detergent particles of Comparative Example II-2 were uni-core detergent particles, but they were poor in their flowability properties.

Comparative Example II-3

Detergent particles were obtained in the same manner as in Example II-1, except that the crystalline alkali metal silicate *6), the powdery builder, was added in Step (B-II) but not in Step (B-I). The properties of the resulting detergent particles are shown in Table 2. The resulting detergent particles were uni-core detergent particles, but they were poor in their flowability properties.

Example III-1

Detergent particles were obtained according to the following process.

<Step (C-I)>

One-hundred parts by weight (20 kg) of base particles at 80° C. as listed in Table 3 and 10 parts by weight (2 kg) of a powdery builder *7) at room temperature were supplied into Lödige Mixer (manufactured by Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-four parts by weight (8.8 kg) of a surfactant composition at 80° C. was supplied into the above mixer in 2 minutes, and the components were then mixed for 5 minutes.

<Step (C-II)>

Thereafter, 10 parts by weight (2 kg) of a powdery builder *5) was supplied into this Lödige Mixer. The main shaft (rotational speed: 120 rpm) and the chopper (rotational speed: 3600 rpm) were rotated for 0.5 minutes.

<Step (C-III)>

Subsequently, 15 parts by weight (3 kg) of fine powder was supplied into this Lödige Mixer. The main shaft (rotational speed: 120 rpm) and the chopper (rotational speed: 3600 rpm) were rotated for 1 minute, and thereafter 33 kg of detergent particles were discharged. The properties of the resulting detergent particles are shown in Table 3. The detergent particles of Example III-1 were more excellent in the dissolubility and the flowability properties than the detergent particles of Example I-2.

Example III-2

Detergent particles were obtained according to the following process.

<Step (C-I)>

One-hundred parts by weight (20 kg) of base particles at 80° C. as listed in Table 3 and 15 parts by weight (3 kg) of a powdery builder *7) at room temperature were supplied into Lödige Mixer (manufactured by Matsuzaka Giken Co., Ltd.; capacity: 130 L; equipped with a jacket), and the rotation of a main shaft (rotational speed: 60 rpm) was started. Incidentally, hot water at 80° C. was allowed to flow into the jacket at 10 L/minute, without rotating a chopper. Forty-four parts by weight (8.8 kg) of a surfactant composition at 80° C. was supplied into the above mixer in 2 minutes, and the components were then mixed for 5 minutes.

<Step (C-II)>

Thereafter, 12 parts by weight (2.4 kg) of a powdery builder *5) was supplied into this Lödige Mixer. The main shaft (rotational speed: 120 rpm) and the chopper (rotational speed: 3600 rpm) were rotated for 0.5 minutes.

<Step (C-III)>

Subsequently, 11 parts by weight (2.2 kg) of fine powder was supplied into this Lödige Mixer. The main shaft (rotational speed: 120 rpm) and the chopper (rotational speed: 3600 rpm) were rotated for 1 minute, and thereafter 33 kg of detergent particles were discharged. The properties of the resulting detergent particles are shown in Table 3. The detergent particles of Example III-2 were more excellent in the deterging ability than the detergent particles of Example I-2. In addition, detergent particles excellent in the flowability properties and the dissolubility could be obtained, even though a large amount of the powdery builder was formulated therein.

TABLE 3

| | Examples | |
|---|---|---|
| | III-1 | III-2 |
| Composition (Parts by Weight) | | |
| Surfactant Composition [Component (c)] | | |
| Nonionic Surfactant *1) | 20 | 20 |
| Immobilization Agent 1 *2) | 2 | 2 |
| Immobilization Agent 2 *3) | 2 | 2 |
| Anionic Surfactant *4) | 20 | 20 |
| Water | 4 | 4 |
| Base Particles [Component (a)] | | |
| Spray-Dried Particle | 100 | 100 |
| Powdery Builder [Component (b), Component (b')] | | |
| Crystalline Alkali Metal Silicate *5) | 10 | 12 |
| Crystalline Alkali Metal Silicate *6) | — | — |
| Crystalline Alkali Metal Silicate *7) | 10 | 15 |
| Fine Powder [Component (d)] | | |
| Crystalline Aluminosilicate *8) | 15 | 11 |
| Amorphous Aluminosilicate *9) | — | — |
| Properties | | |
| Average Primary Particle Size (μm) | 283 | 286 |
| Degree of Particle Growth | 1.09 | 1.10 |
| Bulk Density (g/L) | 790 | 800 |
| Flowability Properties | | |
| Variance of Powder Dropping Rate | 0.6 | 0.7 |
| Flowability (s) | 5.8 | 5.9 |
| Bleed-Out Property (2-Week Storage) | 2 | 2 |
| Anti-Caking Property (2-Week Storage) | 2 | 2 |
| Dissolution Rate (%) | 96 | 95 |

*1) to *9) are the same as those in Table 1.

INDUSTRIAL APPLICABILITY

According to the process of the present invention, there can be obtained uni-core detergent particles having a large amount of surfactants formulated, being excellent in the flowability properties and the dissolubility, and being also excellent in the suppression of the bleed-out of the nonionic surfactant and in the anti-caking property.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing uni-core detergent particles having a degree of particle growth of 1.5 or less and a bulk density of 500 g/L or more, comprising the steps of:

(C-I): mixing base particles for supporting a surfactant which have an average particle size of from 150 to 500 μm and a bulk density of 400 g/L or more (Component (a)), a powdery builder (Component (b')) of which primary average particle size is from 5 to 50 μm in an amount of from 5 to 50 parts by weight, based on 100 parts by weight of Component (a), and a surfactant composition (Component (c));

(C-II): mixing a mixture obtained in Step (C-I) with a powdery builder (Component (b)) of which primary average particle size is from 3 to 30 μm in an amount of from 5 to 50 parts by weight, based on 100 parts by weight of Component (a); and (C-III): mixing a mixture obtained in Step (C-II) with a fine powder (Component (d)) of which primary average particle size is smaller than that of Component (b) in an amount of from 5 to 100 parts by weight, based on 100 parts by weight of said mixture, wherein a formulation ratio of Component (a) and Component (c) in Step (C-I) is such that an amount of Component (c) is from 20 to 100 parts by weight, based on 100 parts by weight of Component (a).

2. The process according to claim 1, wherein Component (b) and/or Component (b') each is a crystalline alkali metal silicate comprising at least $SiO_2$ and $M_2O$ wherein M is an alkali metal, wherein the crystalline alkali metal silicate has an $SiO_2/M_2O$ molar ratio of from 1.5 to 2.6, a maximal value of pH of a 0.1% by weight dispersion thereof at 20° C. exceeding 11.0, and an ion exchange capacity of 100 mg $CaCO_3$/g or more.

3. The process according to claim 1, wherein Component (c) is a composition comprising (i) a nonionic surfactant; (ii) an anionic surfactant having sulfate group or sulfonate group in an amount of from 0 to 300 parts by weight, based on 100 parts by weight of the nonionic surfactant; and (iii) an immobilization agent for the nonionic surfactant in an amount of from 1 to 100 parts by weight, based on 100 parts by weight of the nonionic surfactant.

4. The process according to claim 1, wherein Component (a) has the structure (1) and/or (2):

(1) a structure having pores capable of releasing a bubble of a size of one-tenth or more the particle size of the uni-core detergent particle, when dissolving a uni-core detergent particle in water; or (2) a structure comprising a water-insoluble inorganic compound, a water-soluble polymer and a water-soluble salt, and being localized such that larger portions of the water-soluble polymer and/or the water-soluble salt are present near the surface rather than the inner portion thereof.

5. The process according to claim 1, wherein the uni-core detergent particles have a variance of powder dropping rate of 2.0 or less.

* * * * *